US005295330A

United States Patent [19]

Hoffman

[11] Patent Number: 5,295,330

[45] Date of Patent: Mar. 22, 1994

[54] FLUID THRUST BEARING CENTRIFUGAL DISK FINISHER

[76] Inventor: Steve E. Hoffman, 6 Maple St., Englewood Cliffs, N.J. 07632

[21] Appl. No.: 941,568

[22] Filed: Sep. 8, 1992

[51] Int. Cl.[5] ..... B24B 31/10

[52] U.S. Cl. ..... 51/163.1; 51/164.1; 384/100; 384/279

[58] Field of Search ..... 51/7, 17, 19, 163.1, 51/164.1, 164.2, 163.2; 384/100, 279, 902

[56] References Cited

U.S. PATENT DOCUMENTS

| | | | |
|---|---|---|---|
| 3,119,639 | 1/1964 | Adams . | |
| 3,753,604 | 8/1973 | Arsenius . | |
| 4,073,549 | 2/1978 | Christ et al. . | |
| 4,096,666 | 6/1978 | Brown | 51/164.1 |
| 4,749,283 | 6/1988 | Yokomatsu | 384/279 |
| 4,826,325 | 5/1989 | Iwata et al. . | |
| 4,838,710 | 6/1989 | Ohta | 384/902 |
| 4,850,151 | 7/1989 | Ditscherlein | 51/164.1 |
| 4,884,372 | 12/1989 | McNeil | 51/164.1 |
| 4,939,871 | 7/1990 | Ditscherlein . | |
| 4,958,776 | 9/1990 | Walther | 51/163.2 |
| 5,012,620 | 5/1991 | McNeil . | |
| 5,088,238 | 2/1992 | Lin | 51/164.1 |
| 5,119,597 | 6/1992 | Davidson | 51/164.1 |

*Primary Examiner*—Jack Lavinder
*Attorney, Agent, or Firm*—Fred A. Keire; Brenda Pomerance

[57] ABSTRACT

A centrifugal disk finisher includes a porous layer at the bottom of the vertical wall of the containment vessel. A pressurized fluid, preferably air, is forced through the porous layer so as to form a fluid bearing between the bottom of the porous layer and the spinning disk enclosed within the containment vessel. The containment vessel is levitated above the spinning disk by a small amount due to the presence of the fluid bearing, so that the disk spins without any contact with the containment vessel, thus reducing wear. The fluid bearing also acts as a seal, which repels particles from the interface between the disk and the porous layer due to the small height of the fluid bearing and its imperviousness to all but the most energetic particles.

33 Claims, 3 Drawing Sheets

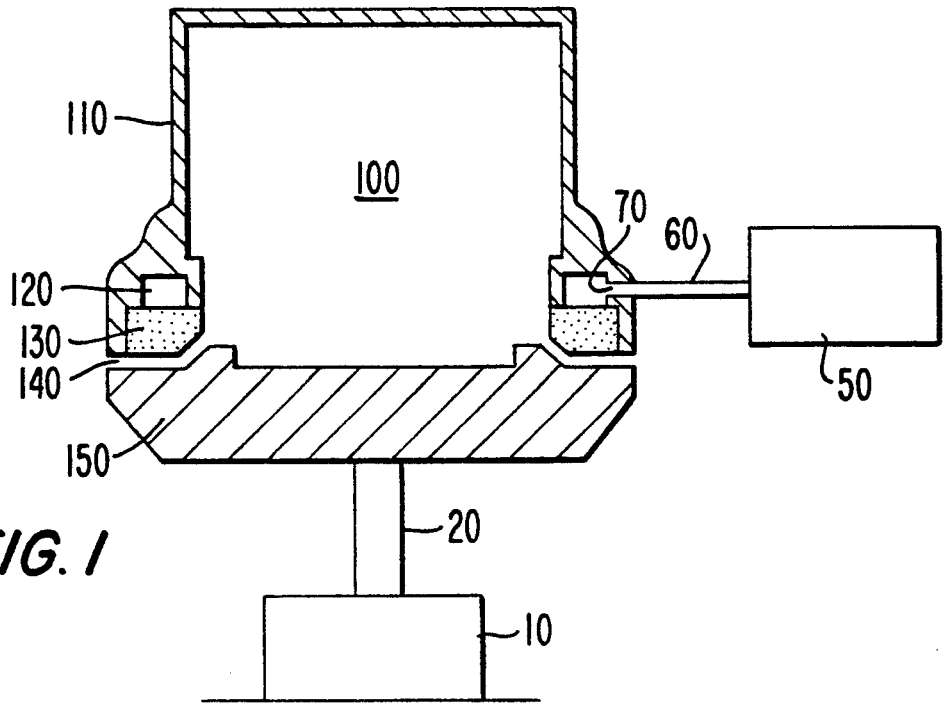
FIG. 1
FIG. 2
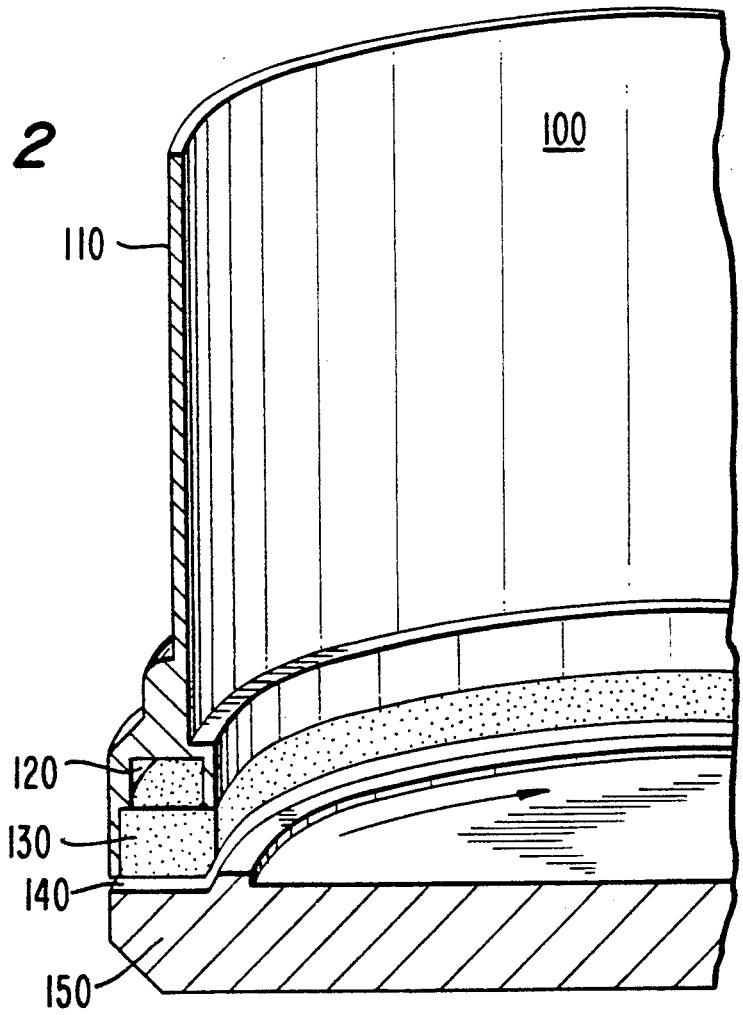

FLUID THRUST BEARING CENTRIFUGAL DISK FINISHER

FIELD OF THE INVENTION

The present invention relates to apparatus for finishing the surface of an object or objects by contact with abrasive pieces, specifically, a stationary containment vessel enclosing abrasive pieces and objects which experience centrifugal force due to a spinning disk.

BACKGROUND OF THE INVENTION

In a conventional centrifugal disk finisher, the abrasive pieces and the object or objects to be finished are placed into a stationary containment vessel which encloses a spinning disk that substantially acts as the floor of the containment vessel. The spinning disk imparts centrifugal force to the abrasive pieces, which collect on the inner wall of the vessel, then eventually fall towards the spinning disk due to gravitational force. The object is finished, that is, polished, by contact with the abrasive pieces experiencing rotatory and gravitational forces.

A persistent difficulty in centrifugal disk finishers has been the design of the interface between the spinning disk and the stationary containment vessel. One source of this difficulty is that small abrasive pieces and abraded particles from the pieces and the object being finished become lodged in the interface between the spinning disk and the inner wall of the stationary containment vessel. Another source of this difficulty is that the material used at the interface wears out quickly due to friction so that the disk finisher requires frequent maintenance.

Various techniques have been used to address this difficulty in known centrifugal disk finishers, such as minimizing the size of the interface, that is, reducing the size of the gap between the spinning disk and the inner wall; using a disk having edges formed so as to direct the pieces and particles away from the interface; and forcing a fluid, such as water or air, into the interface so as to purge the particles and provide lubrication.

However, the technique of minimizing the size of the interface and the technique of using a disk with specially formed edges depend on the availability of precisely formed parts and the maintenance of a constant angular velocity during operation of the disk finisher. The technique of forcing a fluid into the interface depends on the availability of a high pressure, high volume fluid supply, and uses a gap of large size, which prevents both the finishing of small objects and the use of abrasive pieces cf small size. Additionally, the use of water as a fluid is sometimes undesirable.

Furthermore, all known disk finishers experience critical wear after a relatively short amount of use, such as 400 hours, and require replacement of the worn out portion or portions of the disk finisher.

BRIEF DESCRIPTION OF PRIOR ART

U.S. Pat. Nos. 4,884,372 and 5,012,620 (McNeil) relate to a centrifugal disk finisher having a seal between the rotating disk at the bottom of a finishing chamber. Pressurized water is pumped into the seal and flows upwardly around the rotating disk into the chamber. Fines, produced by attrition of finishing material and workpieces, are kept away from the seal by the upwardly moving water. This apparatus requires precisely machined parts and separately supplying water to several points. The gap in the seal between the disk and the walls is as small as 0.004 inch.

U.S. Pat. No. 4,939,871 (Ditscherlein) relates to a centrifugal finisher having a rotating bottom inside a cylindrical casing. The casing is automatically raised and lowered relative to the bottom to hold the width of the gap between the casing and the peripheral edge of the bottom at a specific value. Considerable wear occurs in the walls defining the gap due to removal of the grinding agent during processing, and flow of the processing fluid through the gap.

U.S. Pat. No. 4,850,151 (Ditscherlein) relates to a centrifugal finisher having a rotating bottom inside a cylindrical casing. The casing can be used in an inverted position so as to double its lifetime after abrasion at the bottom of the inner surface in its original orientation due to contact with workpieces and treatment chips during finishing. Clearly, considerable wear occurs in this apparatus.

U.S. Pat. No. 4,826,325 (Iwata et al.) relates to a particle processing apparatus having a disk rotated by a rotating member having a concave outer circumferential edge inside a barrel. An annular bearing member having a convex inner circumferential edge holds the rotating member. Compressed air is injected through ports on the inner surface of the bearing member into the gap formed between the convex inner circumference of the bearing member and the concave outer circumference of the rotating member to prevent particles from clogging the gap. The rotating member floats on a layer of injected compressed air inside the bearing member, avoiding contact with the bearing member to reduce friction and power requirements. The bearing and rotating members require complicated machining due to their respective convex and concave shapes and the required plurality of air injection ports.

U.S. Pat. No. 4,096,666 (Brown) relates to a finishing machine having a rotating base inside a cylindrical tub. Each of the base and the tub has respective frusto-conical sealing members forming a contact seal. The tub sealing member has a plurality of ports through which a fluid coolant is injected, preferably a liquid, to counteract frictional heat, inhibit the entry of particles into the seal, and lubricate the sealing surfaces. However, this apparatus suffers substantial wear due to the contact between the sealing members.

U.S. Pat. No. 4,073,549 (Christ et al.) relates to an apparatus for maintaining a supported part, such as a rotating disk, in a prescribed position under variable loading conditions. The supported part is supported by a bearing shoe which floats between the supported part and a foundation. A hydraulic servomotor is located between the underside of the shoe and the foundation, and counteracts the force applied from the supported part to the bearing face of the shoe. This patent simply shows a technique for supporting a part, and does not address the design of the interface between a rotating disk and a containment vessel.

U.S. Pat. No. 3,753,604 (Arsenius) relates to a cup-shaped hydrostatic bearing having an interior surface with pockets supplied with a pressurized fluid which lubricates the bearing surface and carries the load of a rotatable member located within the bearing. This patent does not address the design of the interface between the rotatable member and a containment vessel.

U.S. Pat. No. 3,119,639 (Adams) relates to a hydrostatic thrust bearing located between the base of a rotatable shaft and the bearing surface of a non-rotatable element. A freely floating annulus is provided in a recess at the base of the shaft, allowing higher pressure between the shaft base surface and the bearing surface due to the stepped edges of the annulus which retard fluid flow. The gap between the base of the shaft and the bearing surface is 0.004 inch. However, this patent does not address the design of the interface between the spinning disk and a containment vessel.

BRIEF SUMMARY OF THE INVENTION

The present invention provides a centrifugal disk finisher having the advantage of substantially excluding abrasive pieces from the interface between the containment vessel and the spinning disk.

Further, the present invention provides a centrifugal disk finisher having the advantage of not requiring frequent maintenance because of its outstanding design.

Still further, the present invention provides a centrifugal disk finisher having yet another advantage of being able to employ parts formed within relatively generous tolerances.

In accordance with one aspect of the present invention, a centrifugal finisher for finishing an object comprises a containment vessel having a base and at least one vertical wall for containing the object and for containing a plurality of abrasive pieces, a disk at the base of the containment vessel for supporting the abrasive pieces and the object, means for rotating the disk relative to the containment vessel, a plenum at a lower portion of the at least one vertical wall of the containment vessel for receiving a fluid, and a porous layer between the plenum and the disk for passing the fluid from the plenum towards the disk so as to produce a boundary region between the porous layer and the disk as a bearing for the containment vessel.

BRIEF DESCRIPTION OF THE DRAWINGS

The following detailed description, given by way of example and not intended to limit the present invention solely to the embodiment shown and described herein, will best be understood in conjunction with the following drawings in which:

FIG. 1 is a schematic view of a centrifugal disk finisher according to the present invention and associated drive and fluid supply systems.

FIG. 2 is a cutaway view of the containment vessel useful in explaining the present invention;

DETAILED DESCRIPTION OF THE PREFERRED EMBODIMENTS

Figure 3:
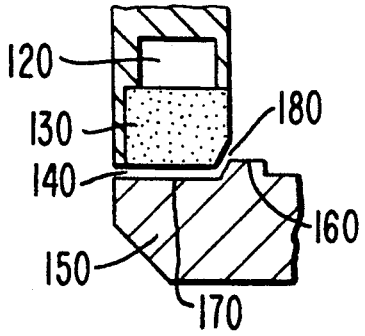
FIG. 3 is a side view of the apparatus shown in FIG. 2.

The present invention includes a novel interface between the spinning disk and the stationary containment vessel. Specifically, a pressurized fluid, preferably air, is forced between the spinning disk and the bottom of the wall of the containment vessel so as to form a layer of pressurized fluid as a fluid thrust bearing which levitates the containment vessel a small height above the disk. An apparatus according to the present invention includes a spinning disk at the base of a containment vessel, but not enclosed therein. The disk acts as a floor, supporting abrasive pieces and the object or objects to be finished, which move thereto due to gravitational force. In contrast, known centrifugal disk finishers include a spinning disk enclosed within a containment vessel.

Since the height of the fluid thrust bearing is very small, typically being controlled to be 1/100 th the size of the smallest abrasive piece by varying the fluid supply, the majority of abrasive pieces and abraded particles are excluded therefrom simply because they are too big. Furthermore, smaller particles are also excluded from the fluid bearing by repulsion from the pressurized fluid, which affects all but the most energetic particles. Material suitable for the abrasive pieces includes silicon carbide, aluminum oxide, diamond, and any abrasive in powder form. Tests have used abrasive pieces as large as 0.5 inches and as small as 0.03 inches, but the invention is not confined to use of abrasive pieces of this size. A novel aspect of the present invention is its ability to use very small abrasive pieces.

Alternatively, the abrasive pieces may be compressed felt chunks having a particulate abrasive coating material thereon, such as those described in U.S. Pat. No. 5,140,783, having a common inventor herewith, and which is incorporated herein by reference.

No appreciable wear of parts at the interface has been observed after in excess of 1000 hours of operation, which is in stark distinction from the prior art.

Objects that have been finished using a centrifugal disk finisher according to the present invention include hypodermic needles, decorative metal stamping, jewelry, ball bearings, plastic components including bearings and decorative items, ornamental pewter and airbag sensors. Both the inner and outer surfaces of airbag sensor tubes have been finished, whereas the only known prior art methods for achieving a suitably smooth finish on the inside of airbag sensors involved manual polishing. Since the rolling of a metal ball down the inside of the airbag sensor tube, jarred from its restraining magnet by the impact of a collision, is what triggers inflation of an airbag, it is vital that the finish on the inside of the tube be smooth. Also, rust has been removed from objects using a centrifugal disk finisher according to the present invention.

The finishing time for an object varies widely, and can range from 10 minutes or less to two hours or more. The surface finish achieved using the present invention is less than 2 microinches.

Referring now to the drawings, and in particular to FIG. 1, there is illustrated a centrifugal disk finisher according to the present invention, including motor 10, shaft 20, fluid source 50, fluid duct 60, fluid port 70, containment vessel 100, containment vessel wall 110, fluid plenum 120, porous layer 130, fluid bearing 140 and disk 150.

The apparatus illustrated in FIG. 1 is adapted to contain abrasive pieces and object(s) to be finished in containment vessel 100 which is shown as essentially barrel shaped, although other shapes could be used. The abrasive pieces and objects are supported and have motion imparted thereto by a disk 150. A motor 10 is adapted to rotate a shaft 20 which is connected to the disk 150 at the center of its underside so as to rotate the disk 150. The rotational speed of the motor is expected to be in the range of 60–450 revolutions per minute (rpm), although the speed of the motor is not critical and other speeds may be used. The present invention does not depend on an exact rotational speed of disk 150.

The base of containment vessel wall 110 is shown as having a broader cross-section than the top of the wall, so as to provide more strength at the base and room for the internal structures. However, the exact cross-sectional profile of containment vessel wall 110 is not a consideration insofar as the plenum 120 and the porous layer 130 must be accommodated. Also, as discussed in more detail below, the structures located internally at the base of containment vessel wall 110 could be located internal to disk 150.

Porous layer 130 is located at the base of containment vessel wall 110 so that the bottom of porous layer 130 faces the top of disk 150. It is preferred, but not required, that one side of porous layer 130 face the interior of containment vessel 100. It is preferred, but not required, that the other side of porous layer 130 be located inside vessel wall 110. The top of porous layer 130 is in contact with the fluid plenum 120. Fluid passes from plenum 120 through porous layer 130 and escapes through the unenclosed portions of layer 130. It is preferred, but not required, that the ratio of the cross-sectional areas of the porous layer 130 and fluid plenum 120 be at least 1, and this ratio depends on the material used for porous layer 130 and the pressure and flow rate of the fluid.

Porous layer 130 can be formed of a sintered material such as a polyalkylene plastic, for example, a polymethylene oxide such as Delrin TM or a polyethylene halide, a polycarbonate plastic, for example, Lexan TM, Teflon TM, ceramic or aluminum. Porous layer 130 may alternatively be formed of a material having a plurality of very small holes drilled or cut therein, such as Delrin TM, ultra=high molecular weight (UHMW) polyethylene, steel or concrete. The holes, or voids, must be sufficiently small, preferably smaller than 1/16 inch, and numerous, preferably forming at least 10% of the material, for the fluid forced therethrough to be a substantially continuous layer, although neither the size nor the regularity of the spacing of the holes is critical. Alternatively, bronze bearing material, formed of sintered particles with a diameter in the range of 60 to 135 microns, may be used to form porous layer 130, so that the operation of the centrifugal disk finisher could continue even in the event of a slight or total loss of the fluid source 50. In tests, bronze bearing material was used in place of a fluid bearing 140, and proved effective for very short periods.

Fluid source 50 is adapted to supply fluid through fluid duct 60 to fluid plenum 120. The fluid is preferably compressed air at a pressure of about 2 psig, that is, a gauge reading of 2 psi, rather than an absolute value, supplied at a rate of at least 40 $ft^2$ per minute, but could be another gas at ambient pressure, or even a liquid such as water. The required pressure is that which holds the weight of the containment vessel distributed over the fluid bearing. For example, if the containment vessel has a weight of 50 lbs., a diameter of 36 inches, and a width at the base of its wall of about 1 inch, then the minimum pressurization of the fluid is $50/(36\times1)$ or about 1.5 psig. Preferably, the fluid flow rate increases with an 18 increase in either of the size of the holes in porous layer 130 and the rotational speed of disk 150.

Fluid duct 60 is shown as terminating at a fluid port 70 located on the outside of fluid plenum 120. However, other fluid supply arrangements such as multiple fluid ducts terminating at respective fluid ports of the fluid plenum are also suitable. The present invention also comprehends multiple fluid plena arranged around the base of vessel wall 110 which result in essentially uniform fluid flow throughout the base of porous layer 130.

FIG. 2 shows a cutaway view of the containment vessel, including containment vessel 100, containment vessel wall 110, fluid plenum 120, porous layer 130, fluid bearing 140, and disk 150.

Air passes from the fluid plenum 120 into the porous layer 130. Due to the porosity of porous layer 130, the air from the fluid plenum 120 passes through the bottom of porous layer 130 and forms a fluid bearing 140, consisting of air at high pressure, between the bottom of the layer 130 and the top of disk 150. Air "leaks" from the outside edge of the fluid bearing 14 into the environment, and from the inside edge of the fluid bearing 140 into the containment vessel 100.

Because of the porosity of porous layer 130, the fluid bearing 140 acts to levitate the containment vessel 100 a very small distance above the disk 150 so that the disk is free to spin without contacting the stationary containment vessel 100, thus reducing wear at the interface between the disk and the containment vessel relative to prior art designs. The fluid bearing 140 also acts as a seal, which repels particles from the interface between disk 150 and layer 130 due to its small height and imperviousness to all but the most energetic particles.

In tests, the fluid bearing 140 has been maintained at a height of about 1/100 th the size of the smallest abrasive piece, usually 20–30 microns, that is, about 0.001 inch. However, the height of the fluid bearing is not critical and can be as small as desired, with the constraint being the precision in machining of the disk surface.

A centrifugal disk finisher according to the present invention can be manufactured with large tolerances relative to the prior art, because the fluid bearing 140 adapts its size to manufacturing variations.

Air also passes through the side of layer 130 located towards the inside of the containment vessel so as to form a partial shield for the opening between the disk and layer 130 which deflects particles falling down the inside of the containment wall 110 from the fluid bearing 140, and so as to repel incident particles from the base of containment vessel wall 110, thereby reducing wear.

FIG. 3 shows a side view of the apparatus illustrated in FIG. 2. The disk 150 is seen to include an inset 170, which is a band around the outer edge of disk 150. The width of the inset 170 is somewhat less than the width of containment vessel wall 110. Located at the inner edge of inset 170, radially inside the top surface of the disk 150, is a raised barrier 160 which directs particles away from the fluid bearing, and also keeps the containment vessel centered on the disk. The inside wall of the barrier 160, towards the center of the disk, is approximately vertical, while the outside wall of the barrier 160 is angled. The base of the inside of the porous layer 130 is also angled. The angles of the base of the layer 130 and the outside wall of the barrier 160 are complementary, forming an interface gap 180, extending upwards from the inner edge of fluid bearing 140, which is at an angle perpendicular to the expected trajectory of the particles.

FIGS. 4A–4E show alternative configurations for the interface, which defines the fluid bearing 140, between the spinning disk and the containment vessel.

Figure 4A:
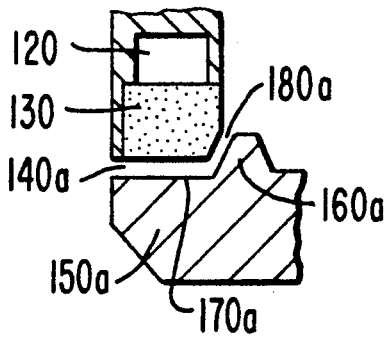
FIGS. 4A–4E show alternative configurations of the present invention.

In the configuration shown in FIG. 4A, disk 150*a* includes an inset 170*a*, similar to the correspondingly numbered portion of FIG. 3. A raised barrier 160*a* having angled walls is located at the inner edge of inset 170*a*. The bottom of porous layer 130 and the outer wall of barrier 160*a* form an interface gap 180*a* which lies completely behind the barrier 160*a* so as to be protected from incident particles. The bottom of the containment vessel wall is supported by fluid bearing 140*a* at less than the height of the raised barrier 160*a*.

In the configuration shown in FIG. 4B, disk 150*b* includes a channel 190 around the edge of the disk and slightly below the level of the disk 150*b*. Channel 190 acts as a reservoir for storing very small particles so they do not remain trapped in fluid bearing 140 as a disruptive influence. The width of the channel 190 is shown as less than the width of the combination of the base of the containment vessel wall and the base of the porous layer 130*b*; but the width of the channel 190 can also be approximately equal to the width of this combination. The base of the porous layer 130*b* has vertical walls, for ease in manufacturing. The containment vessel may be held within restraints which keep it approximately centered over the disk, as shown, for example, in FIG. 5.

Figure 4B:
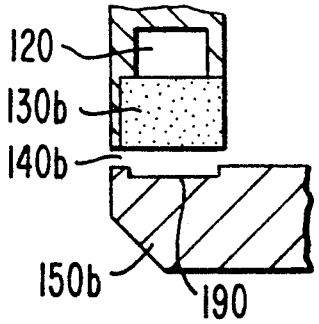
Figure 4C:
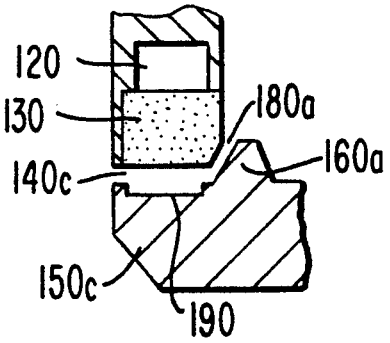
Figure 4D:
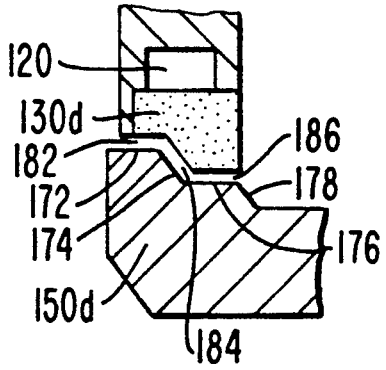
Figure 5:
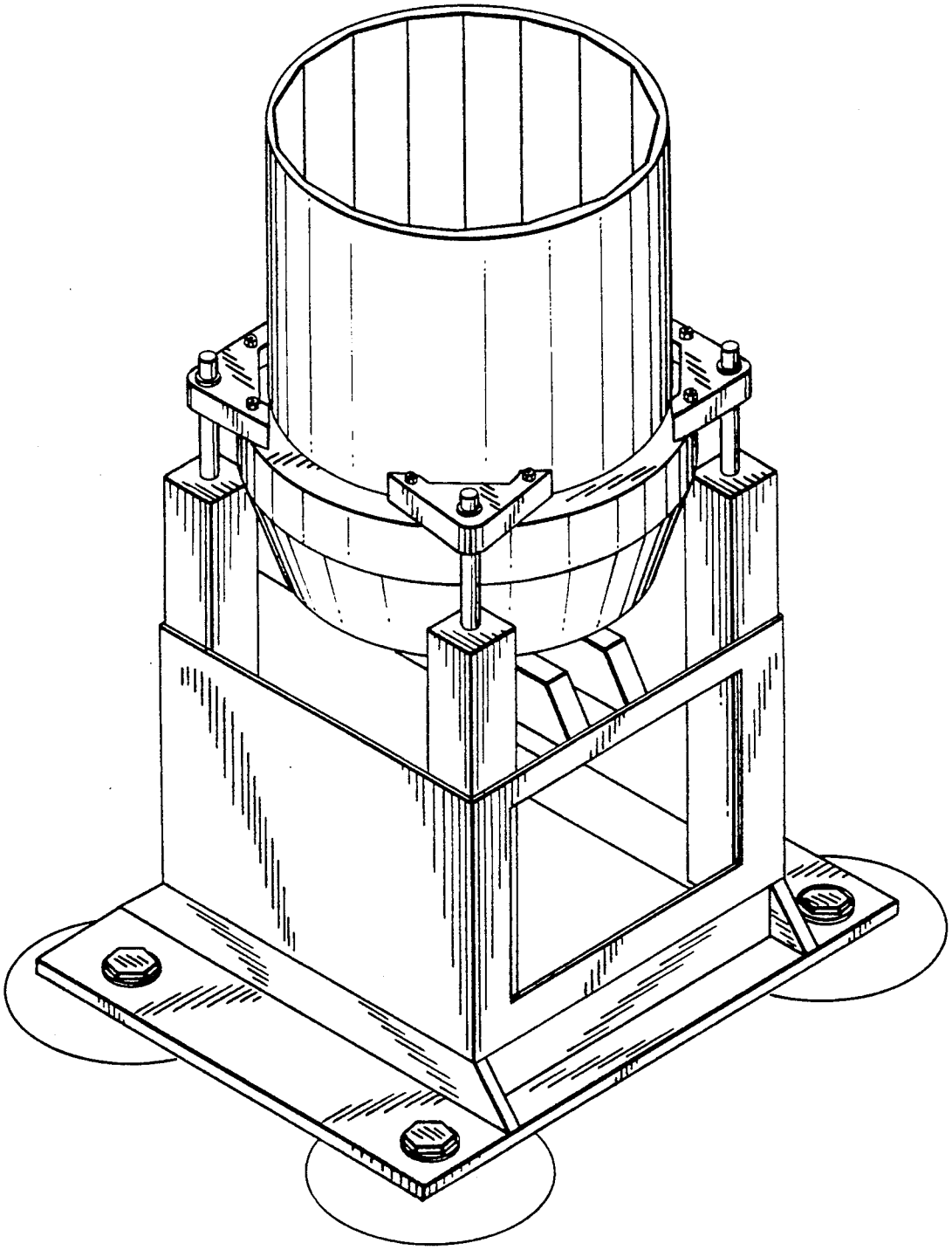
FIG. 5 is a view of a centrifugal disk finisher according to the present invention in a suitable housing.

FIG. 4C shows a configuration including the features of FIGS. 4A and 4B, namely, a channel 190 acting as a reservoir on the outer edge of disk 150*c*, and a raised barrier 160*a* radially inside the surface of disk 150*c* relative to the channel 190. Again, the width of the channel can be less than or equal to the width of the combination of the base of the containment vessel wall and the base of porous layer 130.

In the configuration shown in FIG. 4C, disk 150*d* has a stepped edge including steps 172 and 176, and sloped risers 174 and 178. Porous layer 130*d* has a correspondingly sloped base. The outer edge of the disk 150*d* keeps the containment vessel centered and supports fluid bearing portions 182, 184 and 186.

Figure 4E:
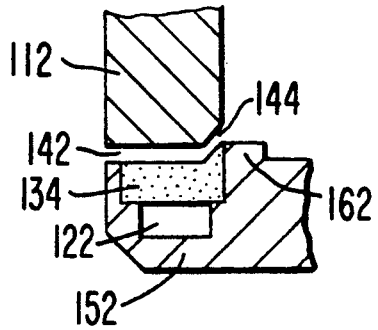

In the configuration shown in FIG. 4E, the containment vessel wall 112 is devoid of internal structures. Fluid plenum 122 and porous layer 134 are located in disk 152. The fluid source supplies fluid to plenum 122 through a duct, not shown, preferably inside the shaft connected to the center of the disk. Disk 152 is seen to include a raised barrier 162 with porous layer 134 forming the outer circumference of the barrier 162, but other arrangements are also contemplated. Fluid bearing 142 extends upwards through an interface gap 144 at an angle perpendicular to the expected trajectory of incident particles.

Although illustrative embodiments of the present invention, and various modifications thereof, have been described in detail herein with reference to the accompanying drawings, it is to be understood that the invention is not limited to this precise embodiment and the described modifications, and that various changes and further modifications may be effected therein by one skilled in the art without departing from the scope or spirit of the invention as defined in the appended claims.

What is claimed is:

1. In a centrifugal finisher for finishing at least one object comprising:

a containment vessel having a base and at least one vertical wall for containing said at least one object and for containing a plurality of abrasive pieces, a disk at the base of said containment vessel for imparting motion to said abrasive pieces and said at least one object, and means for rotating said disk relative to said containment vessel, the improvement comprising:

a plenum at a lower portion of said at least one vertical wall of said containment vessel for receiving a fluid, and a porous layer of a porous material between said plenum and said disk for passing said fluid from said plenum towards said disk, and wherein said containment vessel is operative for movement in a predetermined direction, and said fluid passed from said plenum moves said containment vessel in said predetermined direction so as to produce a boundary region between said porous layer and said disk as a bearing for said containment vessel.

2. A centrifugal finisher as in claim 1, wherein said fluid is air.

3. A centrifugal finisher as in claim 1, further including means for supplying said fluid to said plenum at a high pressure.

4. A centrifugal finisher as in claim 3, wherein said fluid is air and said pressure is about 2 psig.

5. A centrifugal finisher as in claim 1, wherein said porous material is a sintered medium.

6. A centrifugal finisher as in claim 5, wherein said sintered medium is one of ceramic, aluminum or plastic material selected from the group consisting of polyalkylene, polymethylene oxide, polyethylene halide and polycarbonate.

7. A centrifugal finisher as in claim 1, wherein said porous material is bronze of sintered particles with diameters in the range 60 to 135 microns.

8. A centrifugal finisher as in claim 1, wherein said porous material is a solid substance with voids of size at most 1/16 inch that are at least 10% of said solid substance.

9. In a centrifugal finisher for finishing at least one object comprising:

a containment vessel having a base and at least one vertical wall for containing said at least one object and for containing a plurality of abrasive pieces, a disk having a top surface at the base of said containment vessel for imparting motion to said abrasive pieces and said at least one object, and means for rotating said disk relative to said containment vessel, the improvement comprising:

a plenum at a lower portion of said at least one vertical wall of said containment vessel for receiving a fluid, and a porous layer of a porous material between said plenum and said disk and having a bottom surface which is parallel to said top surface of said disk for passing said fluid from said plenum towards said disk so as to produce a boundary region between said bottom surface of said porous layer and said top surface of said disk as a bearing for said containment vessel, said boundary region having a predetermined height.

10. A centrifugal finisher as in claim 9, wherein said abrasive pieces have a minimum size and wherein said predetermined height of said boundary region is approximately 1/100 th of the minimum size of said abrasive pieces.

11. A centrifugal finisher as in claim 9, wherein said predetermined height of said boundary region is about 20–30 microns.

12. A centrifugal finisher for finishing at least one object, comprising:

a containment vessel having a base and at least one vertical wall for containing said at least one object and for containing a plurality of abrasive pieces, said containment vessel being operative for movement in a predetermined direction, a disk at the base of said containment vessel for imparting motion to said abrasive pieces and said at least one object, means for rotating said disk relative to said containment vessel, a plenum at a lower portion of said at least one vertical wall of said containment vessel for receiving a fluid, and a porous layer of a porous material between said plenum and said disk for passing said fluid from said plenum towards said disk so as to move said containment vessel in said predetermined direction, thereby producing a boundary region between said porous layer and said disk as a bearing for said containment vessel.

13. A centrifugal finisher as in claim 12, wherein said fluid is air.

14. A centrifugal finisher as in claim 12, further including means for supplying said fluid to said plenum at a high pressure.

15. A centrifugal finisher as in claim 12, wherein said fluid is air and said pressure is about 2 psig.

16. A centrifugal finisher as in claim 12, wherein said porous material is a sintered medium.

17. A centrifugal finisher as in claim 16, wherein said sintered medium is one of ceramic, aluminum or plastic material selected from the group consisting of polyalkylene, polymethylene oxide, polyethylene halide and polycarbonate.

18. A centrifugal finisher as in claim 12, wherein said porous material is bronze of sintered particles with diameters in the range 60 to 135 microns.

19. A centrifugal finisher as in claim 12, wherein said porous material is a solid substance with voids of size at most 1/16 inch that are at least 10% of said solid substance.

20. A centrifugal finisher as in claim 12, wherein said disk has a top surface and an outer edge, and said top surface includes a channel circumferentially around said disk and near said outer edge for storing particles abraded from said abrasive pieces and said object.

21. A centrifugal finisher as in claim 12, wherein said disk has a stepped edge including at least one step and at least one riser for supporting said boundary region.

22. A centrifugal finisher as in claim 12, wherein said porous layer is located at said base of said containment vessel.

23. A centrifugal finisher as in claim 12, wherein during rotation of said disk, said containment vessel is located at a distance from said disk so that said disk rotates without contacting said containment vessel.

24. A centrifugal finisher for finishing at least one object, comprising:

a containment vessel having a base and at least one vertical wall for containing said at least one object and for containing a plurality of abrasive pieces, a disk having a top surface at the base of said containment vessel for imparting motion to said abrasive pieces and said at least one object, means for rotating said disk relative to said containment vessel, a plenum at a lower portion of said at least one vertical wall of said containment vessel for receiving a fluid, and a porous layer of a porous material between said plenum and said disk and having a bottom surface which is parallel to said top surface of said disk for passing said fluid from said plenum towards said disk so as to produce a boundary region between said bottom surface of said porous layer and said top surface of said disk as a bearing for said containment vessel, said boundary region having a predetermined height.

25. A centrifugal finisher as in claim 24, wherein said abrasive pieces have a minimum size and wherein said predetermined height of said boundary region is approximately 1/100 th of the minimum size of said abrasive pieces.

26. A centrifugal finisher as in claim 24, wherein said predetermined height of said boundary region is about 20–30 microns.

27. A centrifugal finisher for finishing at least one object, comprising:

a containment vessel having a base and at least one vertical wall for containing said at least one object and for containing a plurality of abrasive pieces, a disk having a top surface and an outer edge, said disk located at the base of said containment vessel for imparting motion to said abrasive pieces and said at least one object, said top surface having an inset extending circumferentially around said disk near said outer edge and a raised barrier extending circumferentially around said disk radially inside said inset, means for rotating said disk relative to said containment vessel, a plenum at a lower portion of said at least one vertical wall of said containment vessel for receiving a fluid, and a porous layer of a porous material between said plenum and said disk and having a bottom surface for passing said fluid from said plenum towards said disk so as to produce a boundary region between said porous layer and said disk spanning substantially all of said inset, said boundary region including an interface gap between said raised barrier and said bottom surface of said porous layer as a bearing for said containment vessel.

28. A centrifugal finisher as in claim 27, wherein said raised barrier has a predetermined height and said bottom surface of said layer is maintained by said boundary region at a height approximately equal to said predetermined height of said raised barrier.

29. A centrifugal finisher as in claim 27, wherein said raised barrier has a predetermined height and said bottom surface of said layer is maintained by said boundary region at a height less than said predetermined height of said raised barrier.

30. A centrifugal finisher for finishing at least one object, comprising:

a containment vessel having a base and at least one vertical wall for containing said at least one object and for containing a plurality of abrasive pieces, a disk at the base of said containment vessel having a top surface and an outer edge for imparting motion to said abrasive pieces and said at least one object, said top surface of said disk including a channel circumferentially around said disk and near said outer edge for storing particles abraded from said abrasive pieces and said at least one object and further including a raised barrier adjacent to said channel and inside an inside circumference of said channel, means for rotating said disk relative to said containment vessel, a plenum at a lower portion of said at least one vertical wall of said containment vessel for receiving a fluid, and a porous layer of a porous material between said plenum and said disk for passing said fluid from said plenum towards said disk so as to produce a boundary region between said porous layer and said disk as a bearing for said containment vessel.

31. A centrifugal finisher for finishing an object, comprising:

a containment vessel having a base and at least one vertical wall for containing said object and for containing a plurality of abrasive pieces, a disk at the base of said containment vessel for imparting motion to said abrasive pieces and said object, means for rotating said disk relative to said containment vessel, a plenum at an outer portion of said disk for receiving a fluid, and a porous layer of a porous material at said outer portion of said disk and above said plenum for passing said fluid from said plenum towards said containment vessel so as to produce a boundary region between said porous layer and said containment vessel as a bearing for said containment vessel.

32. A centrifugal finisher as in claim 31, wherein said fluid is air.

33. A centrifugal finisher as in claim 31, wherein said at least one vertical wall has a bottom surface, and wherein said boundary region extends along substantially all of said bottom surface.

* * * * *